United States Patent [19]

Nishikawa

[11] 3,991,923

[45] Nov. 16, 1976

[54] ADHESIVE TAPE HOLDER MEANS

[76] Inventor: Kenji Nishikawa, 42, 3-Chome, Arakawa, Higashiosaka, Osaka, Japan

[22] Filed: Mar. 4, 1975

[21] Appl. No.: 555,234

[52] U.S. Cl. ..... 225/20; 225/21; 225/88

[51] Int. Cl.[2] ..... B26F 3/02

[58] Field of Search ..... 225/19, 20–22, 225/39, 46, 47, 56, 67, 68, 71, 84–85, 88, 91, 92; 83/397, 397.1, 398

[56] References Cited

UNITED STATES PATENTS

| | | | |
|---|---|---|---|
| 2,290,223 | 7/1942 | Black et al. | 83/397 |
| 2,663,369 | 12/1953 | Erhardt | 225/20 |
| 3,521,800 | 7/1970 | Stephens et al. | 225/90 X |
| 3,731,863 | 5/1973 | Nausedas | 225/20 |

*Primary Examiner*—Othell M. Simpson
*Assistant Examiner*—Fred A. Silverberg
*Attorney, Agent, or Firm*—Bacon & Thomas

[57] ABSTRACT

In an adhesive tape holder means a sheathing plate is mounted to one end of the means in vertically movable relation with respect to a cutting blade rigidly fixed adjacent to said end; the sheathing plate has a sliding element engaged with a cam mounted adjacent to said plate and having one end projected outwardly from one side of the means by a spring. When a pushing force is applied to said end, the cam is forced to move across the axis of the means to move down the sheathing plate, causing the blade to come out of the plate. When the force is released, the cam returns to its original position and simultaneously the sheathing plate moves up to sheathe the blade.

1 Claim, 6 Drawing Figures

ADHESIVE TAPE HOLDER MEANS

The present invention relates generally to improvements in an adhesive tape holder means and more particularly to an improved construction of device for rotatably supporting an adhesive tape roll such as an electrically insulated polyvinyl chloride tape on cellophane tape both in the form of a roll having one side coated with an adhesive agent, for drawing out a desired length of tape from the device and cutting the same by means of a cutting blade mounted on the device.

Most of the conventional adhesive tape holder means with use for business office and workshop are either composed, for example, of a relatively heavy pedestal to the bottom of which is stuck a rubber sheet having a great coefficiency of friction, and the upper portion of which is formed axially thereof with a groove so as to rotatably support an adhesive tape roll supporter formed independently, or of a tape holder body integrally formed with a tape roll supporter so as to permit a tape roll to frictionally move thereon when a length of tape is pulled out.

In accordance with the above-mentioned tape holder means, a cutting blade in the form of a razor blade or saw teeth is fixed to an upper foremost end of the means in upwardly exposed relation, thus giving rise to the jeopardies that it easily hurts a user's fingers and tears his clothes.

Accordingly, the present invention has been designed to eliminate the above-mentioned drawbacks and has as its main object the provision of an adhesive tape holder means which enables a user to easily and safely cut any length of tape by means of a sharp cutting blade.

These and other objects, features and advantages of the invention will become apparent from the following detailed description of the invention when taken in conjunction with the accompanying drawings, in which.

Figure 1:
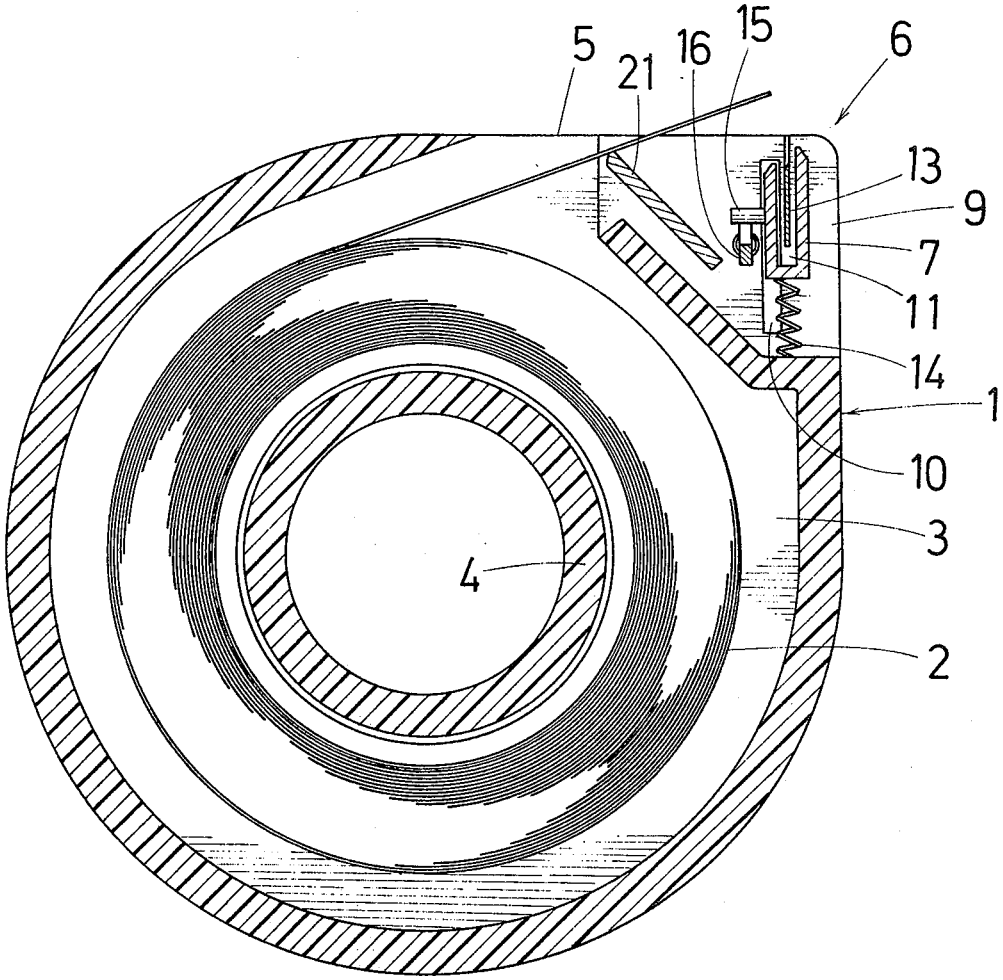
FIG. 1 is a vertical cross-sectioned view showing a preferred embodiment of an adhesive tape holder means in accordance with the invention.
Figure 2:
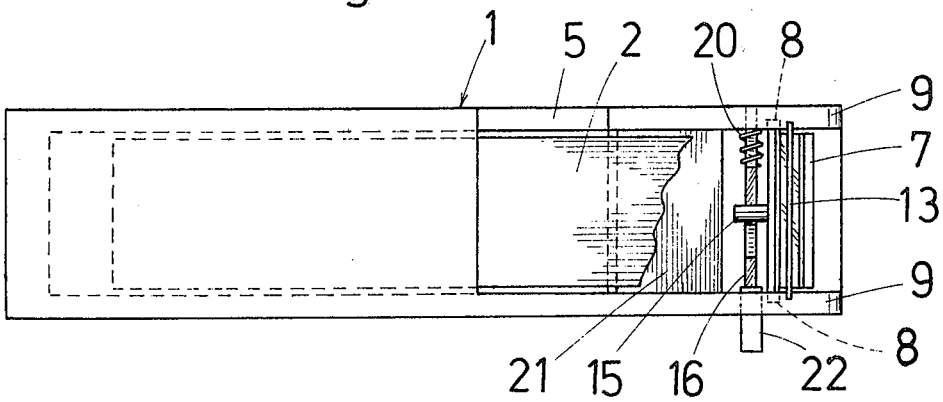
FIG. 2 is a top plan view thereof.
Figure 3:
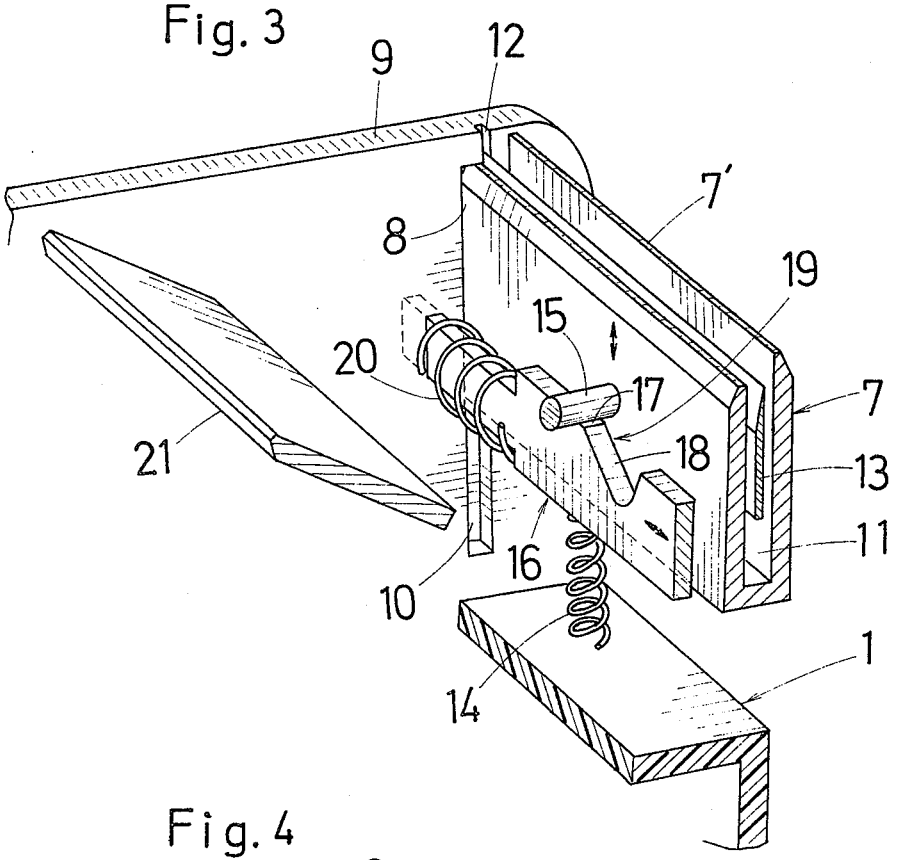
FIG. 3 is an enlarged cutaway perspective view showing elemental parts of FIG. 1.

Referring now to the accompanying drawings, and first more particularly to said first embodiment of the invention, reference numeral 1 generally designates an adhesive tape holder means. Said means 1 is, as the whole, formed internally with a spatial room 3 for accommodating an adhesive tape roll 2 and centrally with a fixed supporting shaft 4 supported on one side of the spatial room 3. A side plate or fixing plate 5 disposed opposedly to the fixed supporting shaft 4 is detachably mounted to the tape holder means 1 so that in order to mount the roll 2 onto the means 1, the fixing plate 5 is removed from the means 1 before inserting the roll 2 onto the fixed supporting shaft 4, thereafter the plate 5 being mounted again to the means 1.

At the side of an opening 6 for drawing out a length of tape there is disposed a protecting or sheathing plate 7 adapted to slidably move in vertical directions. A pair of slidable elements 8 disposed at both sides of said sheathing plate 7 are slidably mounted in vertical guide groove 10 formed internally of fixing plates 9 disposed opposedly to one another.

Further said sheathing plate 7 is formed internally with a vertical groove 11 wherein a safety razor shape straight line cutting blade 13 is mounted in both ends thereof to grooves 12 engraved in the inside of said fixing plates 9. Between the lower portion of the sheathing plate 7 and the tape holder means 1 there is held a tensile spring 14 so as to normally press the plate 7 in downward direction.

From the inside of the sheathing plate 7 there is projected a pin 15 perpendicularly to the plate 7 while a cam 16 disposed to correspond to the lower portion of the pin 15 is slidably inserted in both ends thereof into the fixing plates 9.

Said cam 16 has a middle portion consisting of an upper horizontal surface cam member 17 and a guide cam member 19 including an inclined surface cam member 18 formed by notching the cam 16 in the manner that said guide cam member 19 is normally held in contact with said lower portion of the pin 15 projecting from the sheathing plate 7.

Further one end of said cam 16 is provided with a constrictive spring 20 adapted to slidably move the cam 16 toward the other end 22 thereof so as to move the pin 15 upwardly against the tensile spring 14 by means of the guide cam member 19 and at the same time forcibly project said other end 22 outwardly of the fixing plates 9.

In a position between the sheathing plate 7 and the adhesive tape roll 2 a guide plate 21 is fixedly mounted to the fixing plates 9 thereby to guide the back of the tape portion being drawn out.

In case of utilizing the above-mentioned tape holder means 1, said other end 22 of the cam 16 is pressed against the resiliency of the constrictive spring 20 from the outside of the fixing plate 9 so as to slidably move the cam 16 in the direction of the cam 16 opposite to the other end 22 of the cam 16 whereby the horizontal surface cam member 17 is moved from the pin 15 to bring the latter into contact with the inclined surface cam member 18, consequently the pin 15 being moved down along the member 18.

Along with this downward movement of the pin 15, the sheathing plate 7 is also moved down to expose the cutting blade 13 to the upper edge portions 7' of the plate 7 so that any length of the adhesive tape portion 2 drawn out can be easily cut across the axial direction thereof.

After the cutting operation has been effected, a user has only to cease his finger-tip pressing operation against the other end 22 so that the cam 16 is forced to slidably move by the pressing force of the constrictive spring 20 to result in the inclined surface cam member 18 of the guide cam 19 pushing the pin 15 upwardly against the resiliency of the tensile spring 14.

Simultaneously the sheathing plate 7 is raised to return to its original position, sheathing the cutting blade 13 into the plate 7 through the full length thereof. In this case, the pin 15 is placed on the horizontal surface cam member 17 so as to be prevented from moving down itself from a position wherein the cutting blade 13 is sheathed in the sheathing plate 7.

In the foregoing embodiment of the invention, description has been made of the tape holder means 1 wherein the guide cam member 19 of the cam 16 comprises the horizontal surface cam member 17 and the inclined surface cam member 18 formed by notching the cam 16 so that the pin 15 of the sheathing plate 7 is brought into contact with the guide cam member 19 by means of the tensile spring 14 to vertically move the plate 7 along with the slidable movement of the cam 16.

Figure 4:
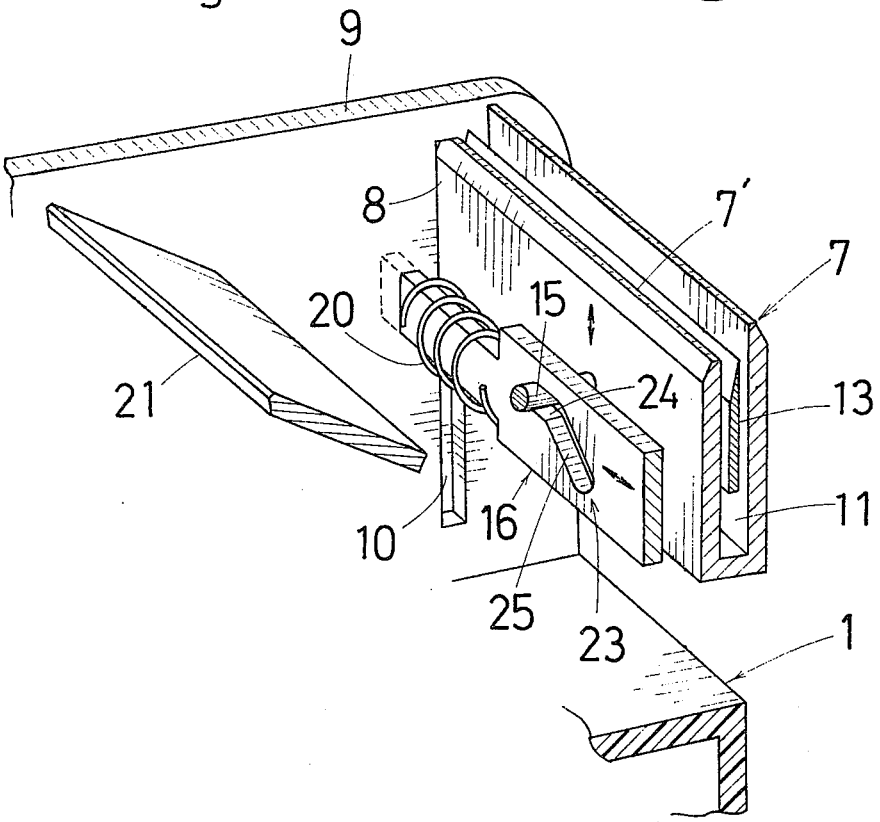
FIG. 4 is likewise an enlarged cutaway perspective view showing a modification of the invention.

However, said pin 15 may be engaged with the sheathing plate 7 through a guide cam groove 23 formed thereon with a horizontal slot 24 and an inclined slot 25 as shown in FIG. 4 thereby vertically moving the plate 7 without resorting to the pulling force of the tensile spring 14.

Figure 5:
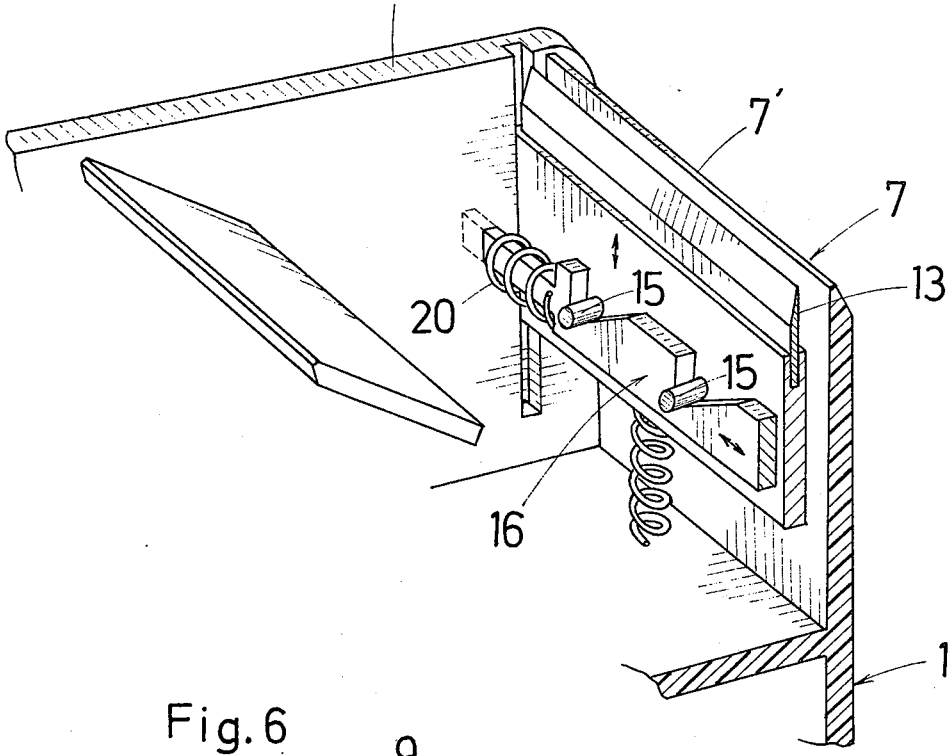
FIG. 5 is likewise an enlarged cutaway perspective view showing another modification thereof.
Figure 6:
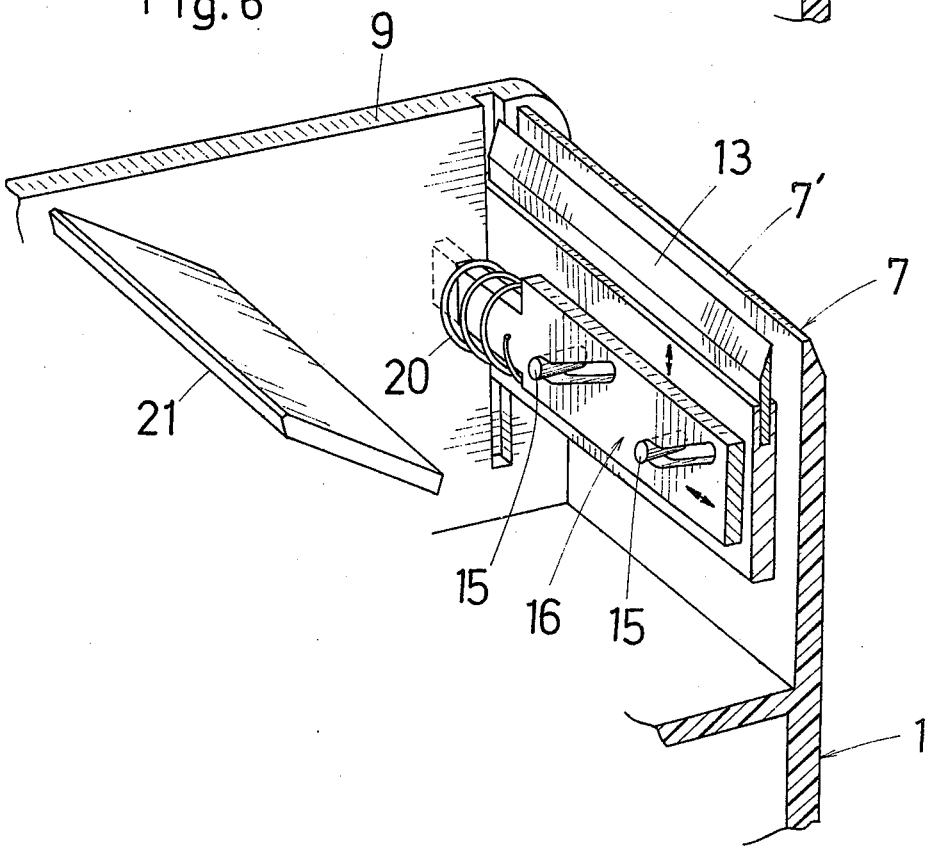
FIG. 6 is likewise an enlarged cutaway perspective view showing a still modification thereof.

Further in the foregoing embodiment, description has also been made of the construction wherein the sheathing plate 7 is vertically movable by means of the cam 16 with the cutting blade 13 kept in stationary state so as to permit the blade 13 to come out of the plate 7. However, such a construction may be available that the cutting blade 13 itself can move vertically with respect to the sheathing plate 7 by rigidly fixing the latter to the tape holder means 1 as definitely shown in FIGS. 5 and 6, respectively.

Further another construction may still be available that both the sheathing plate 7 and the cutting blade 13 are vertically movable with respect to one another whereby they can move in mutually reverse directions by means of the cam 16, though not shown in the accompanying drawings.

As has been clearly mentioned in the foregoing description, it will be understood that according to the invention the blade 13 is normally sheathed in the sheathing plate 7 when not in use and the cam 16 does not act to permit the blade 13 to come out of the plate 7 as long as it is not forcibly pushed by a user's fingertip. Thus even if a single piece of sharp cutting blade such as a safety razor having a straight line edge is applied to the tape holder means 1 to cut a length of adhesive tape, a user is able to mount a new tape roll to the means 1 and pull out a desired length therefrom quite free of dangers which otherwise might occur to him by inadvertently touching any portion of the cutting blade with his hand or fingers.

Though one specific embodiment of the present invention has been shown and described herein, it will be apparent to those skilled in the art that the invention is not restricted to the details set forth but many changes and modifications may be made without departing from the spirit and scope of the invention as defined in the annexed claims.

I claim:

1. An adhesive tape holder means comprising a straight line cutting blade for cutting a length of adhesive tape, a sheathing plate movably mounted with respect to said blade, a cam means adapted to normally keep said sheathing plate in a position wherein said blade is sheathed through the full length thereof, said cam means being movable to move at least said sheathing plate with respect to said blade to expose said blade, a. a pair of fixing plates constituting a tape holder body, b. a space for rotatably and removably receiving an adhesive tape roll between said fixing plates, c. said sheathing plate supported between the ends of said fixing plates in vertically slidable relation, d. a long groove on said sheathing plate, e. said cutting blade received in said groove of said sheathing plate and fixed at both ends to said fixing plates, f. a pin projecting from one side of said sheathing plate in perpendicular relation thereto, g. a cam disposed adjacent to said sheathing plate, being formed on the upper edge thereof with a horizontal surface cam member normally in contact with said pin and an inclined surface cam member downwardly extending from the former member, h. holes through said fixing plates to slidably support said cam between said plates, i. a constrictive spring held between one of said fixing plates and said cam so as to normally press said cam against the other fixing plate, j. a tensile spring held between the lower portion of said tape holder means and said cam so as to normally pull down said cam, k. a foremost end of said cam slidably supported in one of said holes through said fixing plate and normally projected outward from said hole, and l. a guide plate disposed between said cam and a tape roll received in said space so as to guide a tape portion being drawn out.

* * * * *